United States Patent [19]

Roberts

[11] 4,127,348

[45] Nov. 28, 1978

[54] ROAD STUDS

[75] Inventor: John Roberts, Cheltenham, England

[73] Assignee: Indigrade Limited, Cheltenham, England

[21] Appl. No.: 791,879

[22] Filed: Apr. 28, 1977

[30] Foreign Application Priority Data

May 12, 1976 [GB] United Kingdom ..... 19475/76

[51] Int. Cl.[2] ..... E01F 9/04

[52] U.S. Cl. ..... 404/16; 350/97

[58] Field of Search ..... 404/16, 15, 9, 11; 116/63 R; 350/97

[56] References Cited

U.S. PATENT DOCUMENTS

| | | | |
|---|---|---|---|
| 1,927,756 | 9/1933 | Ross | 404/16 |
| 2,260,498 | 10/1941 | Wise | 404/16 |
| 2,703,038 | 3/1955 | Shaw | 404/16 |
| 3,093,038 | 6/1965 | McRobbie | 404/16 |
| 3,516,337 | 6/1970 | Gubela | 404/16 X |
| 3,975,108 | 8/1976 | Suhr | 404/16 |

*Primary Examiner*—Nile C. Byers, Jr.

*Attorney, Agent, or Firm*—Young & Thompson

[57] ABSTRACT

The body of a road stud has oppositely directed presented faces each of which includes a central portion in which reflective elements are disposed and outer protective skirt portions which are inclined to the horizontal at a smaller acute angle than the central portion and project outwardly beyond the central portion.

3 Claims, 3 Drawing Figures

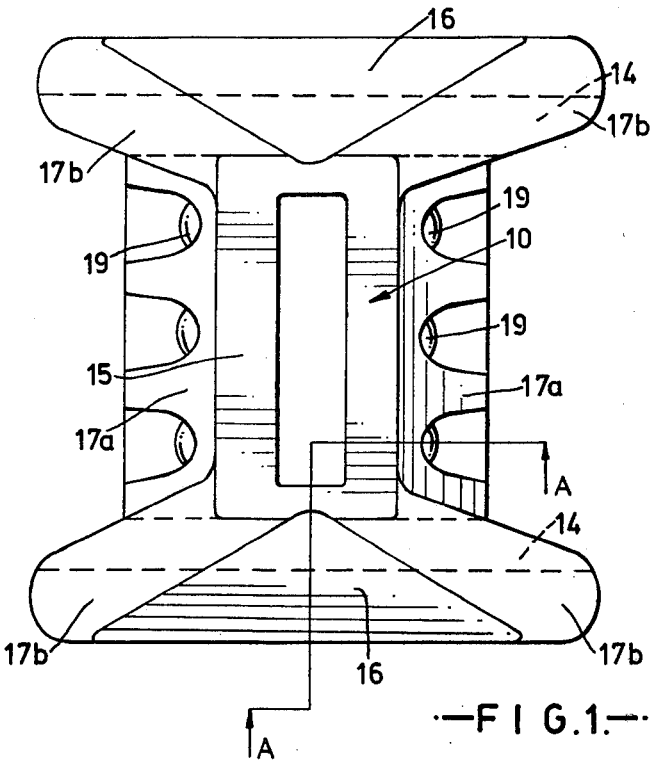
—FIG.1—
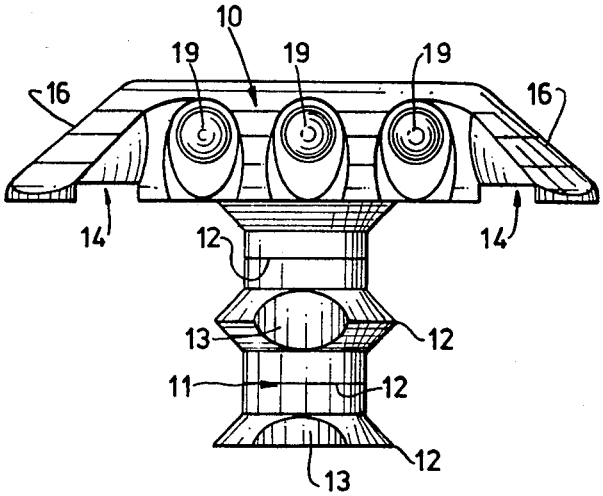
—FIG.2—

ROAD STUDS

This invention relates to road studs and is concerned with that type of road stud which includes a body provided with one or more reflective elements, the road studs being used either as lane markers or boundary markers along the edge of a road.

According to the invention there is provided a road stud the body of which includes two operative faces each of which incorporates one or more reflective elements, each of said operative faces including a first portion in which the reflective element or elements is or are disposed and a second portion which has a protective function and is, in use, inclined to the horizontal at a smaller acute angle than the first portion and extends outwardly from the body a greater distance than said first portion.

The first portion of each operative face is preferably disposed centrally thereof, so that each operative face has two second portions, one on each side of the first portion. The road stud preferably has a substantially flat or slightly domed upwardly presented surface which merges at its edges with the portions of said operative faces, the centre portion of each operative face, which is effectively inset, typically having an inclination of 45° to the horizontal to ensure optimum reflection of the lights of oncoming vehicles and an effective wiping action as the wheels of the vehicles pass over the stud and the second or outer portions of each operative face having an inclination of about 25° or 30° to the horizontal. Thus, in use, the gradual approach angle afforded by the second portion of each of said operative faces will ensure that the stud will not be torn out of the road surface when the stud is engaged by, for example, the blade of a snow plough.

In order to obtain the optimum reflectivity, there are preferably three bi-convex reflective elements in each of said operative faces, the reflective elements being located in bores in said first portions of the operative faces and so inserted that there is at least a 2° opening at the top and bottom of each element and at least a 15° aperture at the sides thereof. The studs thus comply with the B.S.I. standard.

To provide the required strength and noncorrosion characteristics, the body of the stud may be formed of aluminium as a die-casting and may have an integral shank intended to be embedded in the road surface, the shank being of non-circular cross-section and of non-uniform section throughout its length. To install a stud, a hole of the required dimensions is drilled in the road surface and the shank is embedded in a bituminous or epoxy resin adhesive.

The preferred configuration of the shank comprises a plurality of circumferential ribs formed with pairs of diametrically opposed parallel flats with the arrangement such that the parallel flats of one rib are disposed at right angles to the parallel flats of the adjacent rib or ribs. This configuration consisting of a series of flatted ribs, with the flats offset, not only prevents the shank from being pulled out of the adhesive within which it is embedded but also prevents rotation of the stud about the axis of the shank. There is thus no requirement for projections disposed beneath the body of the stud for locating the stud against rotation though, of course, there is no reason why such locating projections should not be provided to further ensure that the stud does not rotate.

The invention will now be described by way of example with reference to the accompanying drawings, in which:

FIG. 1 is a plan view of a road stud,

FIG. 2 is a front view of the road stud, and

Figure 3:
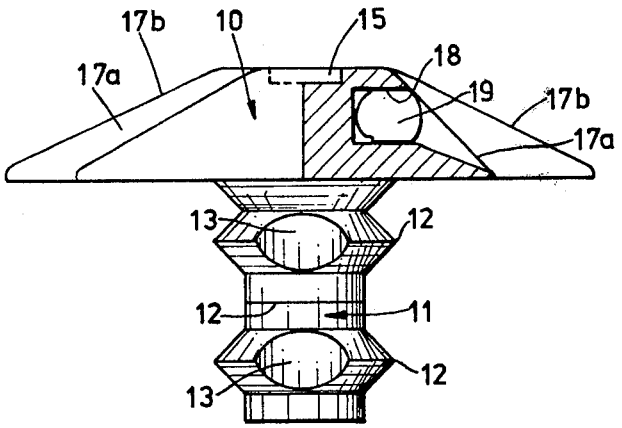
FIG. 3 is a part-sectional end view of the road stud, with the section indicated at A—A in FIG. 1.

The road stud is formed as an aluminium diecasting and consists of a head 10 which is of generally rectangular form in plan view and a shank 11 which is formed with a series of circumferential ribs 12 which are of triangular form in cross-section. Each rib 12 is formed with a pair of diametrically opposed flats 13 and the flats on one rib are positioned at right angles to the flats on the adjacent rib or ribs so that the shank 11 has the configuration shown in FIGS. 2 and 3 so that, when a hole has been drilled in a road surface and the shank 11 has been embedded in a bituminous or epoxy resin adhesive placed in the hole, the shank 11 will be held against turning within the hole or removal therefrom. Rotation of the stud is further prevented by the provision of grooves 14 in the undersurface of the head 10 which provide a mechanical interlocking engagement with the road surface.

The upwardly presented surface of the head 10 includes a central flat portion 15 and the faces 16 of the head which are directed at right angles to the direction of movement of traffic along the roadway are inclined at about 30°. The faces 17 which are disposed in the direction of traffic flow each include a central portion 17*a* inclined at 45° to the horizontal and outer portions 17*b* inclined at 30° to the horizontal. Each central portion 17*a* is formed with three bores 18 containing bi-convex reflective elements 19 fixed in position by means of translucent synthetic resin adhesive. The elements 19 are so inserted that there is at least a 2° opening at the top and bottom of each element and at least a 15° aperture at the sides thereof, this arrangement ensuring that the stud complies with the appropriate B.S.I. standard.

By disposing the reflective elements 19 in parts of the stud surface which are inclined at 45° to the horizontal, optimum reflection of the lights of oncoming vehicles is obtained. In addition, when vehicle wheels pass over the stud, an effective wiping action is obtained. On the other hand, by providing what amounts to a protective skirt at each side of the central portion, the likelihood of the stud being torn out of the road surface upon the application of impacts thereto is substantially avoided.

I claim:

1. A road stud the body of which includes two operative faces each of which incorporates reflective elements, each of said operative faces having outer portions which provide coextensive side ramps and a central portion which provides a steeper and shorter ramp rising between the side ramps to the upper edges thereof, the reflective elements being wholly embedded in the central ramp portion, the reflective elements being bi-convex and being disposed in the central ramp portion in generally horizontal bores which have flared openings into the ramp surface, the side ramps being inclined at between 25° and 30° to the horizontal and the central ramp portion being inclined at about 45° to the horizontal from top to bottom thereof and between said bores.

2. A road stud according to claim 1, including a shank integral with said body, the shank having a plurality of circumferential ribs each formed with parallel flats, the flats of one of said ribs being angularly related to the flats of another of said ribs.

3. A road stud according to claim 1, wherein the undersurface of the body is formed with grooves beneath the side ramps.

* * * * *